US007055541B2

(12) United States Patent
Seifert et al.

(10) Patent No.: US 7,055,541 B2
(45) Date of Patent: Jun. 6, 2006

(54) METHOD AND MECHANISM FOR PRODUCING SUCTION AND PERIODIC EXCITATION FLOW

(75) Inventors: Avraham Seifert, Tel Aviv (IL); Shlomo Pastuer, Haifa (IL)

(73) Assignee: Ramot at Tel-Aviv University Ltd., Tel Aviv (IL)

( * ) Notice: Subject to any disclaimer, the term of this patent is extended or adjusted under 35 U.S.C. 154(b) by 60 days.

(21) Appl. No.: 10/934,434

(22) Filed: Sep. 7, 2004

(65) Prior Publication Data

US 2006/0048829 A1 Mar. 9, 2006

(51) Int. Cl.
*F17D 1/18* (2006.01)
*F15C 1/08* (2006.01)

(52) U.S. Cl. ..... 137/14; 137/826; 137/835; 137/839; 137/840; 137/805

(58) Field of Classification Search ..... 137/834, 137/826, 14, 835, 839, 840, 805
See application file for complete search history.

(56) References Cited

U.S. PATENT DOCUMENTS 3,111,931 A * 11/1963 Bodine ..... 116/137 A
3,228,410 A * 1/1966 Warren et al. ..... 137/818
3,468,326 A * 9/1969 Cohen ..... 137/809
3,628,774 A * 12/1971 Sulich ..... 261/36.2
4,007,625 A * 2/1977 Houben et al. ..... 73/24.01
4,256,015 A * 3/1981 Tippetts et al. ..... 91/364
5,195,560 A * 3/1993 Achmad ..... 137/826

OTHER PUBLICATIONS

Seifert, A., Darabi, A. and Wygnanski, I., 1996, "Delay of Airfoil Stall by Periodic Excitation", J. of Aircraft. vol. 33, No. 4, pp. 691-699.

(Continued)

*Primary Examiner*—A. Michael Chambers
(74) *Attorney, Agent, or Firm*—Mark M. Friedman

(57) ABSTRACT

A method and mechanism of producing a suction and periodic excitation flow. The method includes providing fluid flow from jet port with diameter dl at a controlled input pressure (Pin), directing the flow to a conduit with diameter d2, >d1, allowing additional fluid to join the flow through suction slot(s) to create an amplified flow in the conduit, further directing the amplified flow in a first direction by applying a transverse pressure differential, further redirecting the amplified flow in another direction by modifying an angle by which the transverse pressure differential is applied and iteratively repeating the further directing and further redirecting so that the amplified flow oscillates between the directions. The suction and periodic excitation flows may be employed, for example, to effectively control boundary layer separation. A mechanism for automated performance of the method is also disclosed.

20 Claims, 8 Drawing Sheets

OTHER PUBLICATIONS

Seifert, A. and Pack, L.G., "Oscillatory Control of Separation at High Reynolds Numbers", *AIAA J.* vol. 37, No. 9, Sep. 1999, pp. 1062-1071.

Seifert, A. and Pack, L.G., "Oscillatory Control of Shock-induced Separation", (AIAA paper 99-0925), J. Aircraft, May-Jun. 2001, V38, N3, pp. 464-472.

Seifert, A. and Pack, L.G., "Effects of Compressibility and Excitation Slot Location on Active Separation Control at High Reynolds Numbers", J. Aircraft 40, (1): pp. 110-119 Jan.-Feb. 2003.

Prandtl, L. and Teitjens, O.G., "Applied Hydro and Aeromachanics", Dover, New-york, 1934.

Yehoshua, T. and Seifert, A. "Boundary Condition Effects on Oscillatory Momentum Generator", AIAA Paper 2003-3710, Jun. 2003 (MSc thesis 2004, J. paper to be submitted during 2004).

Seifert, A., Eliahu, S., Greenblatt, D. and Wygnanski, I., 1998, "Use of Piezoelectric Actuators for Airfoil Separation Control (TN)", AIAA J., vol. 36, No. 8, pp. 1535-1537.

Crittenden, T.M., Glezer, A., Funk, R. and Parekh , D., Combustion-driven jet actuators for flow control, AIAA Paper 2001-2768, Jun. 2001.

Michael J. Brear, Zachary Warfield, John F.Mangus, Cpt. Steve Braddom, James D.Paduano and Jeffry S.Philhower, "Flow Separation Within The Engine Inlet Of An Uninhabited Combat Air Vehicle (UCAV)", FEDSM paper 2003-45579, 2003.

Lachman GV. (ed) Boundary layer and flow control. vol. 1 and 2, Pergamon Press. 1961.

Seifert, A. and Pack, L.G., "Active Control of Separated Flow on a Wall-mounted "Hump" at High Reynolds Numbers", AIAA J., V. 40, No. 7, Jul., 2002, pp. 1363-1372. (Part of AIAA paper 99-3430).

Seifert, A., Bachar, T., Koss, D., Shepshelovits, M. and Wygnanski, I., 1993, "Oscillatory Blowing, a Tool to Delay Boundary Layer Separation", AIAA J. vol. 31, No. 11, pp. 2052-2060.

Rapoport, D., Fono, I., Cohen, K. and Seifert, A., "Closed-loop Vectoring Control of a Turbulent Jet Using Periodic Excitation", (AIAA paper 2002-3073), J. Propulsion and Power, V19, N4, Jul.-Aug. 2003, pp. 646-654.

S. Margalit, D. Greenblatt, A. Seifert and I. Wygnanski, "Active Flow Control of a Delta Wing at High Incidence Using Segmented Piezoelectric Actuators", AIAA paper 2002-3270, Jun. 2002. In press to AIAA J. Aircraft, 2003.

Allan et al (2002) Numerical Simulations of Vortex Generator Vanes and Jets on a Flat Plate, AIAA Paper 2002-3160), pneumatic vortex generator jets (e.g., steady and oscillatory, Johnston, et al. (2002) International J. of Heat and Fluid Flow, 23(6):750-757.

Khan and Johnston, (2000) International J. of Heat and Fluid Flow, (21(5): 505-511.).

Tesar et al (New Ways of Fluid Flow Control in Automobiles: Experience with Exhaust Gas After treatment Control: World Automotive Congress F2000H192; Seoul 2000 FISITA; Jun. 12-15, 2000, Seoul, Korea).

* cited by examiner

METHOD AND MECHANISM FOR PRODUCING SUCTION AND PERIODIC EXCITATION FLOW

FIELD AND BACKGROUND OF THE INVENTION

The present invention relates to a method and mechanism for producing suction and periodic excitation flow and, more particularly, to causing periodic oscillation of an amplified flow emanating from a jet port between two or more defined exit directions.

Flow control technology relates generally to the capability to alter flow properties relative to their natural tendency(ies) by introduction of a constant, or periodic, excitation. Use of a periodic excitation for control of boundary layer separation has been demonstrated to be both possible and efficient in incompressible flows (1, 2) especially at low speeds and in a wide range of Reynolds numbers (Re; $10^4$–$10^7$).

Control of boundary layer separation in compressible flows has also been demonstrated, although the level of oscillation required is higher than that required in in-compressible flows (3, 4). Despite this, as long as the flow is free of shock waves, there is no theoretical or physical difference resulting from the mere increase of Mach number. One of the primary uses of flow control is boundary layer control to prevent unwanted boundary layer separation.

Significant scientific and technological effort has been invested in control of boundary layer separation. Alternate methods of flow actuation have been examined including mechanical mixing (e.g. vortex generators, Allan et al (2002) Numerical Simulations of Vortex Generator Vanes and Jets on a Flat Plate, AIAA Paper 2002–3160), pneumatic vortex generatorjets (e.g., steady and oscillatory, Johnston, et al. (2002) International J. of Heat and Fluid Flow, 23(6):750–757 ; and Khan and Johnston, (2000) International J. of Heat and Fluid Flow, (21(5): 505–511.), and cyclic excitation. In an external flow, and at low Re. it has been demonstrated that cyclic excitation is more efficient than steady excitation for boundary layer control by about two orders of magnitude (1). FIG. 1 (1) shows the influence of steady wall jet (solid line) and periodic excitation (dashed line) on the lift generated by a wing profile beyond the stall angle.

In cases where the boundary layer control of a compressible flow is required, there is an urgent need for periodic excitation actuators (PEC) with strong output and suitable frequency range. It is expected that there will be a requirement for excitations with strength comparable to the speed of the flow at the boundary layer edge near the separation region, and frequencies in the range of 100 to 2000 cycles per second. Although valves that operate in this frequency range are available, these valves fail to produce the required excitation strength at the appropriate frequency range. Further, such valves are inefficient and difficult to incorporate into modem jet propulsion systems.

Unsteady flow control of a compressible flow requires an excitation strength that approaches the speed of the flow to be controlled, and a frequency that creates a Strouhal number on the order of 1 (lower limit of 0.25 and upper limit of 0.55), based upon the length of the separated region and the free-stream velocity. Assuming that a flow with a speed 0.7 Mach number is to be controlled, and the length of the separated region is c=0.2 meter the required frequency,$f$, is described by Equation 1 (for standard atmosphere sea-level conditions).

$$f=S_tU_\infty/c=1*340*0.7/0.2=1190\text{ Hz.} \qquad \text{Equation 1.}$$

Creation of excitations with a frequency in this range is possible with Piezo electric flow generators (6) and by mechanical chopper devices (2). However, the maximum intensity of the flow generated by these methods is in the range of 0.3 Mach number. This means that these methods are ill suited for use in control of boundary layer separation in compressible flows, supplying only about half of the required flow output strength, or less than a quarter of the required oscillatory momentum (4).

Mechanical excitation generators that interact directly with the boundary layer (7) have also been tested in this context. However, these devices have, as an inherent disadvantage, a dependency on the velocity gradient of the boundary layer (or more generally the shear-flow) at low speeds and their output periodic excitation capability is limited and for most applications insufficient.

Two additional types of flow actuators (8, 9) relying upon trans- and supersonic flow output speeds are being developed and should be capable of providing the required flow intensity, and more. These supersonic actuators rely upon release of a large quantity of energy in a short time into a small internal cavity inside a body connected to the exterior flow by means of a hole(s) or a slot(s). The first type of actuator relies upon cyclic explosion of flammable materials (as in internal combustion engine) and the second type of actuator relies upon creation of an electrical discharge (as in spark or ark generators) of great magnitude in a small space during a short time and with a defmed repetition rate. The first actuator is currently limited by an upper frequency of 100 cycles/second (e.g. U.S. Pat. No. 6,554,607 to Glezer et al.).

The second type of actuator is similar to the first type, but the entire energy deposition is due to an electric discharge. It remains untested with respect to its ability to cyclically generate the required output flow. These two actuator types share, as inherent disadvantages, a strict requirement for rare materials which are suitable for high temperatures and an undesirable thermal (and perhaps radiant) influence on the surrounding environment. In addition, the requirements for auxiliary cooling systems and the electromagnetic influence on other systems have not yet been determined.

Pneumatic valves that employ compressed air have been developed and demonstrated to be suitable for flow control (10). These pneumatic valves have been applied to compressible flows and it has been concluded that their low energy efficiency will prevent any effective development for use in boundary layer control because of the great pressure differential required by the valve in order to generate the oscillations. This great pressure differential (or loss), even if it can be achieved, would require the use of a rigid durable structure which would be too heavy for use in many applications (e.g. aviation). The combination of pressure differential and increased weight reduce the efficacy of this approach so that any potential advantage to be realized form prevention of boundary layer separation is obliterated.

Flow control dates back to the discovery of the boundary layer by Prandtl. In his historic lecture of 1904, he defmed the boundary layer and the scientific and engineering advantages to be realized from this revolutionary new idea. Prandtl also defined the basic theoretical problems related to control of boundary layer separation. Prandtl went on to explain the solution to these problems, control of the boundary layer separation by suction, applied upstream of the separation point with suppression of the negative phenomena resulting from the flow detachment from the surface. These phenomena leads to reduction in efficiency of the flow related mechanism. Prandtl demonstrated the efficacy of the concept of suction of the boundary layer by placement of suction slots upstream to the boundary layer separation point in a wide angle diffuser, whose boundary layers separated without suction. In the presence of Suction, the flow remained attached to the two walls of the diffuser (5).

Even in a case where suction of the boundary layer prevents separation locally, the adverse pressure gradient becomes larger in many cases and increases geometrically, requiring significant spreading of the flow streamlines and causing boundary layer separation downstream of the point where suction is applied.

The aerodynamic efficiency of suction of the boundary layer has been proven (11) but remains problematic from the standpoint of maintenance in cases where a suction pump is required. Part of the suggested solution from the second half of the $20^{th}$ century is to combine suction from one place with exhaust in another place, in the case of boundary layer control by a steady wall jet.

More recently, (1) it has been proven that boundary layer control by means of cyclic excitation, without mass additions (i.e., zero-mass-flux) is more efficient by two orders of magnitude than the efficiency of boundary layer control by means of a steady wall jet that does not oscillate (FIG. 1).

In contrast, it has been proven that the combination of suction and periodic excitation (with a small but negative averaged mass transfer) increases the efficiency of periodic excitation that serves to control the boundary layer (12), as compare to zero-mass-flux excitation.

In additional experiments (1, 13) it was proven that addition of momentum that "rides" on the excitation frequency does not reduce the efficiency of the periodic excitation with respect to boundary layer control with zero-mass-flux as long a Cμ>0.2% (see Equation 2).

$$C_\mu = \frac{A_{ex}}{A_{wing}}\left(\frac{U_p}{U_\infty}\right)^2 \qquad \text{Equation 2}$$

Where:

$A_{ex}$ is the exit cross section area of the excitation device (s);

$A_{wing}$ is the reference area of the controlled flow;

$U_p$ is the slot exit peak excitation velocity; and $U_\infty$ is the free-stream velocity.

Thus, according to what is currently known, it would seem that in order to control the boundary layer in a compressible flow with speeds in the range of Mach numbers between 0.3 and 0.7, the best combination would be suction near the boundary layer separation point and cyclic exhaust of the same (or amplified) fluid downstream of the suction slot. Implementation of the recommendation will lead to control of the boundary layer in a compressible flow, in a flow that requires a high level of control (e.g. excitation Mach numbers). All of the above considerations apply also to incompressible flow where significant control authority is required.

Because this recommendation employs a valve with a negligible pressure differential and an unimpeded flow path, with no significant turns, it does not seem that there is a limit to the flow speed at the exit from the valve as long as the flow is free of shock waves. To date, exit speeds in excess of 200 m/s have been measured.

There is thus a widely recognized need for, and it would be highly advantageous to have, a method and mechanism capable of overcoming the above limitations.

SUMMARY OF THE INVENTION

According to one aspect of the present invention there is provided a method of producing a suction and periodic excitation flow. The method includes: (a) providing a flow of a fluid from ajet port characterized by a first diameter (d1) at a controlled input pressure (Pin); (b) directing the flow to a conduit characterized by a second diameter (d2) wherein d2 is greater than d1; (c) allowing additional fluid to join the flow through at least one suction slot to create an amplified flow; the at least one suction slot in fluid communication with the conduit; (d) further directing the amplified flow in a first desired exit direction by applying a transverse pressure differential to a longitudinal axis of the flow (e) further redirecting the amplified flow in at least one additional desired exit direction by modifying a circumferential angle by which the transverse pressure differential is applied to the longitudinal axis; and (f) iteratively repeating the further directing and further redirecting so that the amplified flow oscillates between the first desired exit direction and each of the at least one additional desired exit direction.

According to another aspect of the present invention there is provided a suction and periodic excitation flow mechanism. The mechanism includes: (a) a jet port characterized by a first diameter (d1), the jet port capable if directing a flow of a fluid at a controlled input pressure (Pin); (b) a conduit characterized by a second diameter (d2) wherein d2 is greater than d1, the conduit in fluid communication with the jet port and capable of receiving the flow from the jet port; (c) at least one suction slot in fluid communication with the conduit and an environment external to the mechanism, the at least one suction slot capable of allowing additional fluid to join the flow to create an amplified flow; (d) a deflection device capable of applying a transverse pressure differential to a longitudinal axis of the flow to direct the amplified flow in a first desired exit direction and further capable of redirecting the amplified flow in at least one additional desired exit direction by modifying a circumferential angle by which the pressure differential is transverse to the longitudinal axis; and (e) a controller, the controller capable of commanding the deflection device to perform at least one function selected from the group consisting of: (i) apply a transverse pressure differential to a longitudinal axis of the flow to direct the amplified flow in a first desired exit direction; (ii) iteratively repeat a predetermined set of modifications of the circumferential angle by which the pressure differential is transverse to the longitudinal axis so that the amplified flow oscillates between the first desired exit direction and each of the at least one additional desired exit direction; and (iii) cease operation.

According to further features in preferred embodiments of the invention described below, each of the first desired exit direction and each of the at least one additional desired exit direction are independently defined by an exit port belonging to a plurality of exit ports.

According to still further features in the described preferred embodiments the at least one additional desired exit direction includes a single additional exit direction.

According to still further features in the described preferred embodiments the at least one additional desired exit direction includes at least two additional exit directions.

According to still further features in the described preferred embodiments a ration between d2 and d1 is in the range of 1.1:1 and 5:1.

According to still further features in the described preferred embodiments the at least one suction slot/hole is deployed on a surface in contact with a boundary layer of an external fluid flow so that the additional fluid entering the flow via the at least one suction slot/hole includes at least a portion of the external fluid flow.

According to still further features in the described preferred embodiments the providing a flow of the fluid from the jet port is at least partially accomplished by means of at least one oscillatory zero-mass-flux jet.

According to still further features in the described preferred embodiments enhancing of mixing the flow in proximity to a junction between the jet port and the conduit is performed. This mixing may be by passive or active means.

According to still further features in the described preferred embodiments the enhancing of the mixing is accomplished by means of at least one protrusion from an inner surface of the jet port, the at least one protrusion creating a disturbance in the flow as the flow passes thereupon.

According to still further features in the described preferred embodiments the iteratively repeating is accomplished by a mechanism selected from the group consisting of: (i) at least one fluidic valve capable of supplying at least a portion of the pressure differential transverse to a longitudinal axis of the flow with a predetermined periodicity; (ii) at least two resonance tubes, each independently capable of capturing a portion of the amplified flow as the amplified flow flows in one of the desired exit directions and applying the captured portion of the amplified flow transverse to the longitudinal axis of the flow to create the pressure differential with a predetermined periodicity; and (iii) operating at least two opposing zero-mass-flux devices at a predetermined periodicity, each of the zero mass flux devices capable of supplying at least a portion of the pressure differential transverse to a longitudinal axis of the amplified flow.

According to still further features in the described preferred embodiments the iteratively repeating is accomplished employing one oscillating membrane and connecting the control jets to the opposing sides of the membrane.

The present invention successfully addresses the shortcomings of the presently known configurations by providing a method and mechanism which synergistically combine suction ports in fluid communication with an initial flow and oscillation amplified exit flow.

Implementation of the method and system of the present invention may involve performing or completing selected tasks or steps manually, automatically, or a combination thereof. Moreover, according to actual instrumentation and equipment of preferred embodiments of the method and system of the present invention, several selected steps could be implemented by hardware or by software on any operating system of any firmware or a combination thereof. For example, as hardware, selected steps of the invention could be implemented as a chip or a circuit. As software, selected steps of the invention could be implemented as a plurality of software instructions being executed by a computer using any suitable operating system. In any case, selected steps of the method and system of the invention could be described as being performed by a data processor, such as a computing platform for executing a plurality of instructions.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 1:
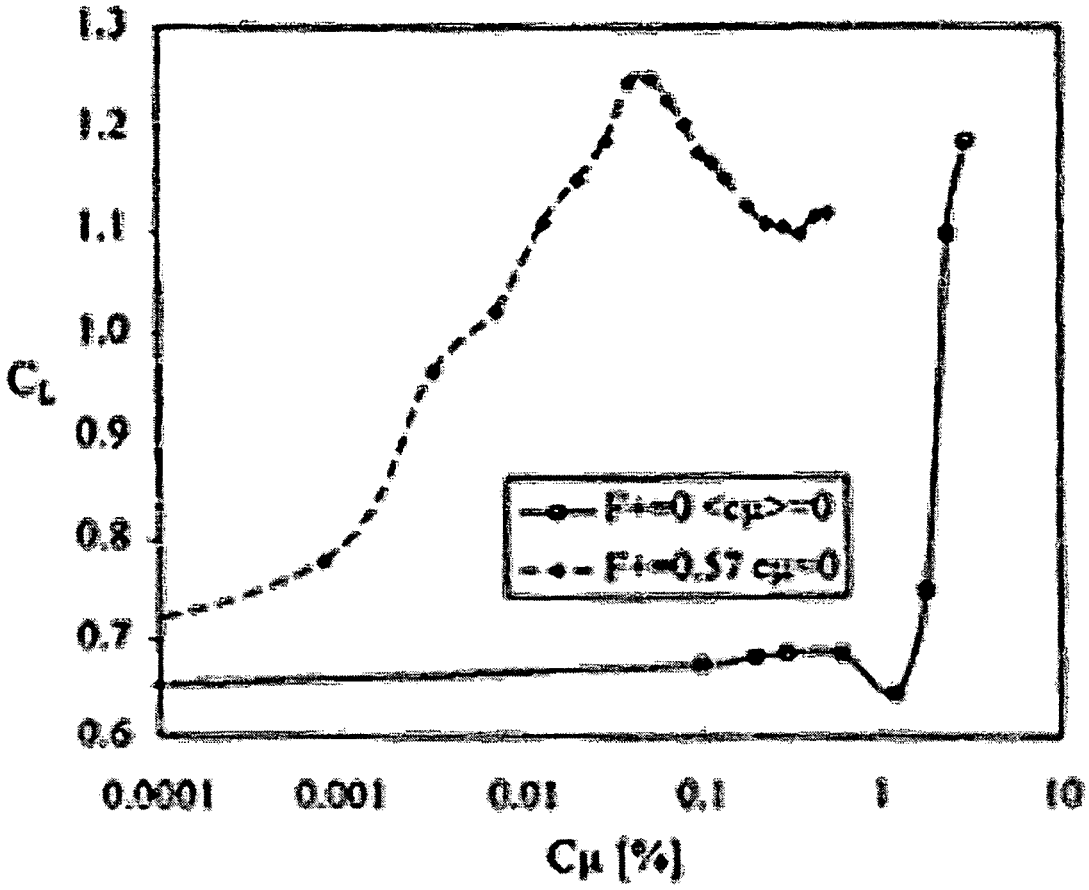
FIG. 1 is a comparative plot of $C_L$ as a function of $C_\mu$ illustrating the relative superior efficiency of periodic over steady excitation for separation control.

The present invention is of method and mechanism which can be employed to produce suction-and-periodic-excitation flow. Specifically, the present invention can be used to control boundary layer separation in a fluid flow.

The principles and operation of methods and mechanisms according to the present invention may be better understood with reference to the drawings and accompanying descriptions.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Figure 4A:
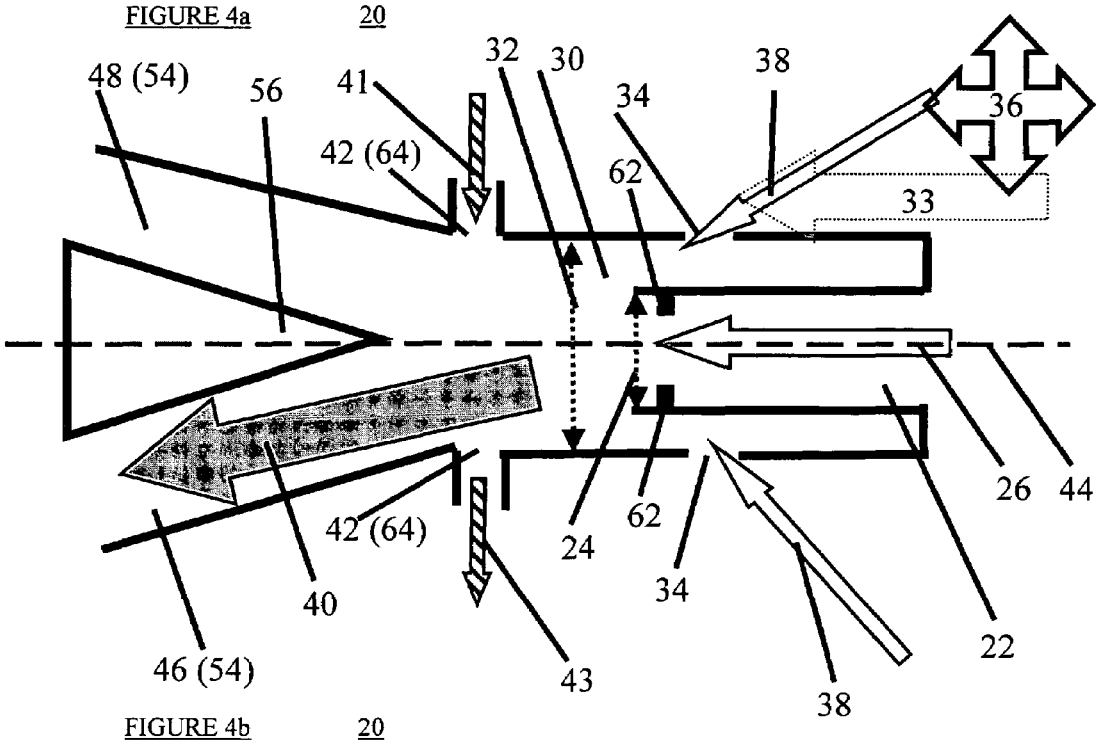
FIGS. 4*a*; 4*b*, 4*c*; 4*d*; 4*e* and 4*f* are cross sectional diagrams of various embodiments of a mechanism according to the present invention illustrating direction of an amplified flow in a first exit direction (4*a*; 4*c*; 4*e*) and at least one additional exit direction (4*b*; 4*d*; 4*f*).

Referring now to the drawings, FIGS. 4*a*; 4*b*, 4*c*; 4*d*; 4*e* and 4*f* illustrate a suction and periodic excitation flow mechanism 20 according to the present invention.

Mechanism 20 includes a jet port 22 characterized by a first diameter 24(d1). Jet port 22 is capable if directing a flow 26 (wide white arrow) of fluid at a controlled input pressure (Pin). The fluid may be, for example, air (gas) or water (liquid) or even two and three phase flow of gas, liquid and solid particles.

Mechanism 20 further includes a conduit 30 characterized by a second diameter 32 (d2). Second diameter 32 d2 is greater than d1 24. Preferably, a ratio between d2 and d1 is in the range of 1.1:1 and 5:1. More preferably, the ratio is in the range of 2:1 and 4:1, most preferably in the range of 2.5:1 and 3.5:1. Conduit 30 is in fluid communication jet port 22 and is capable of receiving flow 26 from jet port 22.

Mechanism 20 further includes at least one suction slot 34 in fluid communication with conduit 30 and an environment 36 external to the mechanism. Suction slot(s) 34 are capable of allowing additional fluid 38 (narrow white arrows) to join flow 26 to create an amplified flow 40 (grey arrow). The term "slot" as used in suction slot 34 is to be construed in its widest possible sense for purposes of this specification and the accompanying claims. Slot, as used herein, refers to any open, or openable, channel of fluid communication. Thus suction slots may be either permanent openings or openable apertures of any cross sectional shape.

Mechanism 20 further includes a deflection device 42 capable of applying a transverse pressure differential (41 and/or 43; cross hatched arrows) to a longitudinal axis 44 of flow 26 to direct amplified flow 40 in a first desired exit direction 46 (FIGS. 4*a*; 4*c* and 4*e*) and further capable of redirecting the amplified flow in at least one additional desired exit direction 48 (FIGS. 4*b*; 4*d* and 4*f*) by modifying a circumferential angle by which pressure differential (41 and/or 43) is transverse to longitudinal axis 44. In the figures, a total of two exit directions 46 and 48 are illustrated because the circumferential angle by which pressure differential (41 and/or 43) is transverse to longitudinal axis 44 has been modified by 180 degrees. It will be appreciated that any total number of exit directions 46 and 48 may be achieved by modifying the circumferential angle by which pressure differential (41 and/or 43) is transverse to longitudinal axis 44 by a circumferential angle defmed by (360 degrees/n) where n is the total number of exit directions 46 and 48 desired. Thus, if n=3, the circumferential angle will be 120 degrees, two additional exit directions 48 will be defmed and a total of three exit directions 46 and 48 will be employed. If n=4, the circumferential angle will bee 90 degrees, three additional exit directions 48 will be defined and a total of four exit directions 46 and 48 will be employed and so on and forth.

Figure 4B:
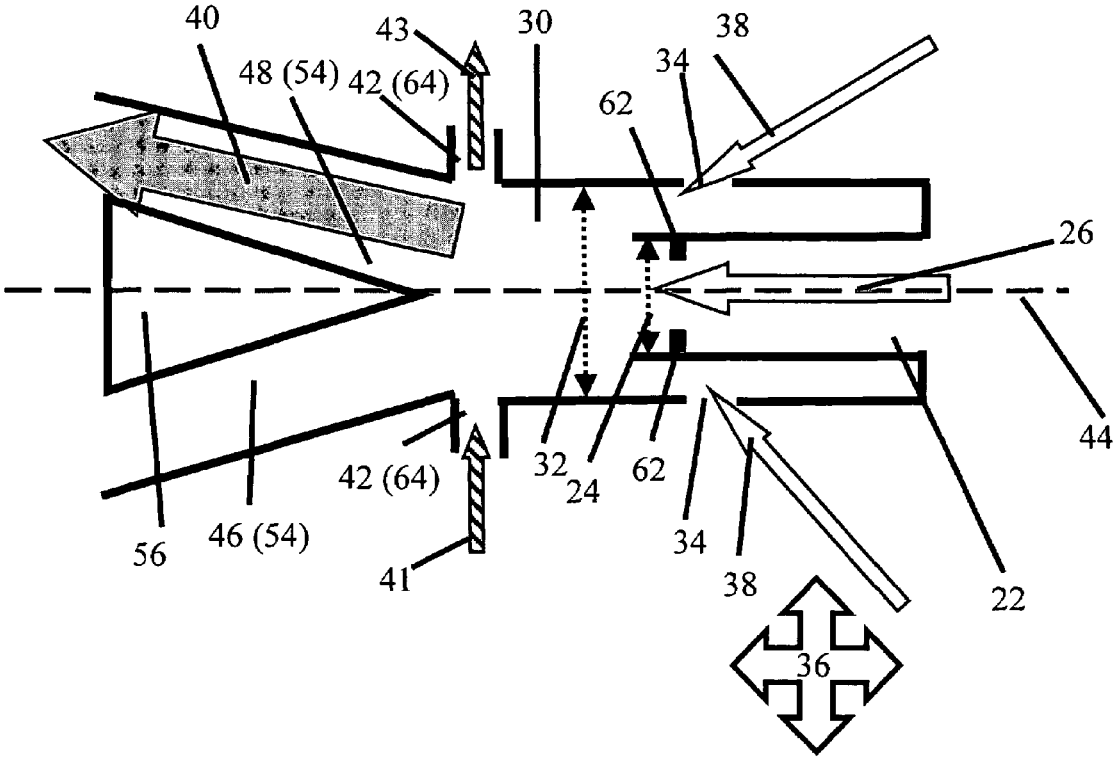

In the pictured embodiments first desired exit direction 46 and additional exit direction 48 are each defmed by an exit port 54. Again, while two exit ports 54 are pictured, the scope of the invention includes mechanisms with as many as n exit ports where n is the total number of exit directions 46 and 48 desired as described hereinabove. Exit ports 54 may be defmed, for example, by introduction of divider 56 into conduit 30. Divider 56 is preferably triangular (FIGS. 4*a* and 4*b*).

It will be appreciated that the total transverse pressure differential is the vector sum of positive differential 41 directed towards axis 44 and negative differential 43 directed away from axis 44. Thus, various embodiments of the invention may employ deflection devices 42 that apply only positive differential(s) 41, that apply only negative differential(s) 43 or that apply both positive differential(s) 41 and negative differential(s) 43.

Similarly, some preferred embodiments of the invention rely upon alternately applying only positive differential 41 and applying only negative differential 43 on the same side of axis 44.

Figure 6:
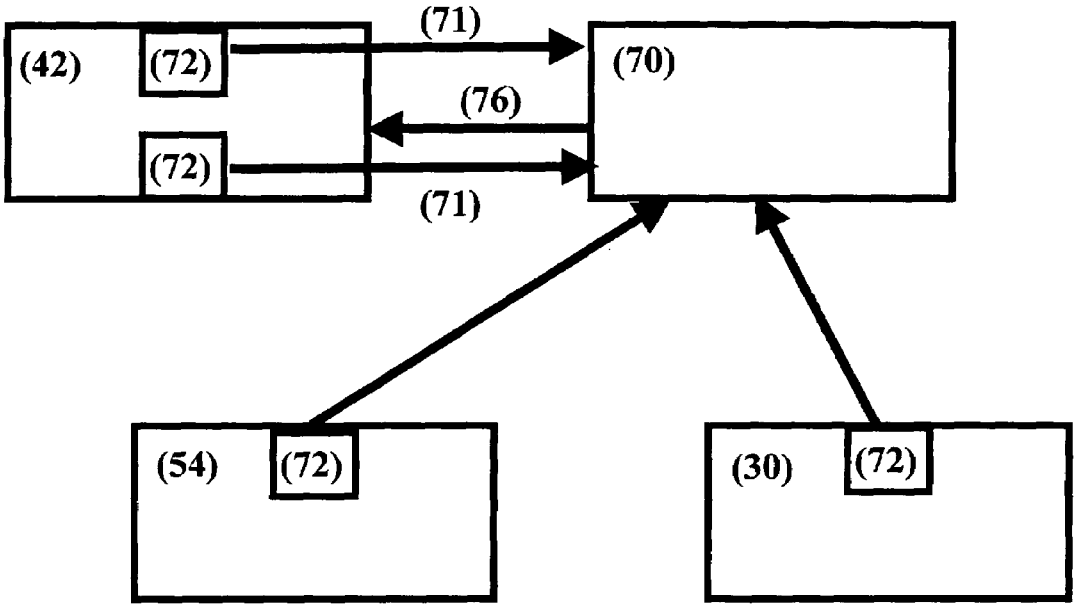
FIG. 6 illustrates communication between a controller and a deflection device in a mechanism according to the present invention.

Preferably, mechanism 20 further includes a controller 70 (FIG. 6). Controller 70 can issue commands 76 to deflection device 42. Commands 76 may include but are not limited to:

a command 76 to apply a transverse pressure differential (41 and/or 43) to longitudinal axis 44 of flow 26 to direct amplified flow 40 in first exit direction 46;

a command 76 to iteratively repeat a predetermined set of modifications of the circumferential angle by which pressure differential (41 and/or 43) is transverse to longitudinal axis 44 so that amplified flow 40 oscillates between first desired exit direction 46 and each of the at least one additional desired exit direction(s) 48; and a command 76 to cease operation of deflection device 42.

Optionally, but preferably, controller 70 receives feedback from monitors 72. Monitors 72 may be placed, for example, in deflection device 42 to monitor transverse pressure differential 41 and/or 43. Alternately, or additionally, monitors 72 may be placed in conduit 30 and/or exit port 54 to monitor amplified flow 40.

Controller 70 may be mechanical, electronic or a combination thereof. Preferably, controller 70 includes a computerized data processing device and suitable hardware interfaces operable by controller 70 with at least a certain level of autonomy once commands 76 are determined. Alternately, or additionally, controller 70 may require manual input of commands 76.

Preferably, suction slot(s) 34 is deployed on a surface in contact with a boundary layer of an external fluid flow 33 (FIG. 4*a*) so that the additional fluid 38 entering flow 26 via at least one suction slot 34 includes at least a portion of external fluid flow 33. External, as used with respect to flow 33, indicates external to mechanism 20.

Figure 4C:
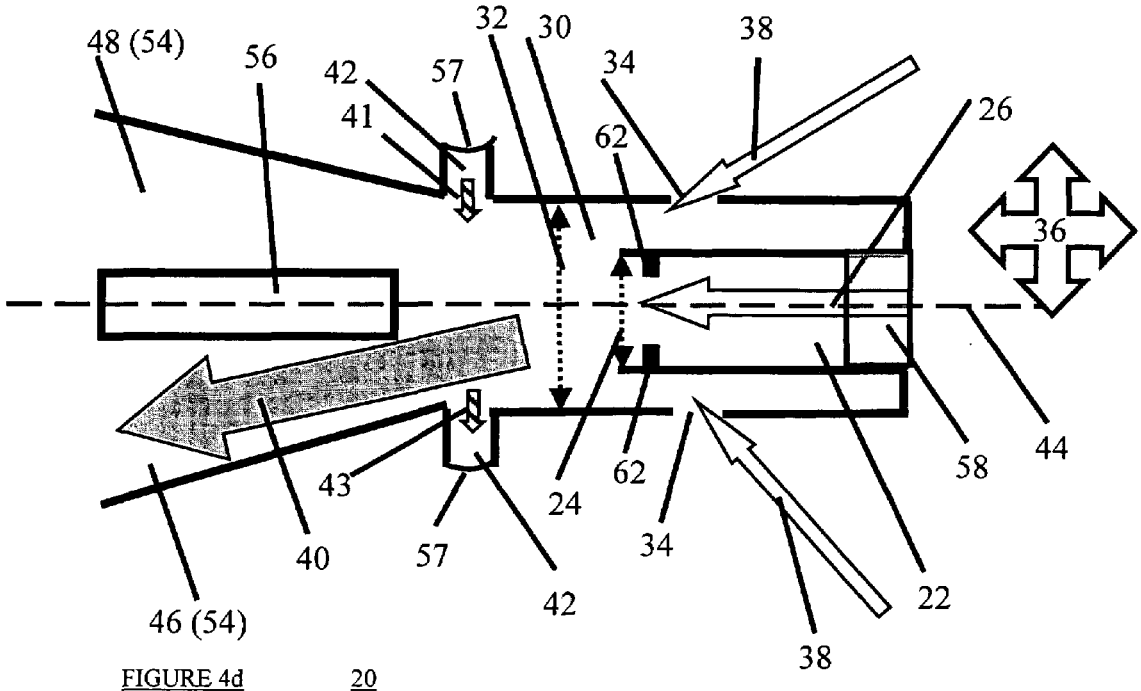
Figure 4D:
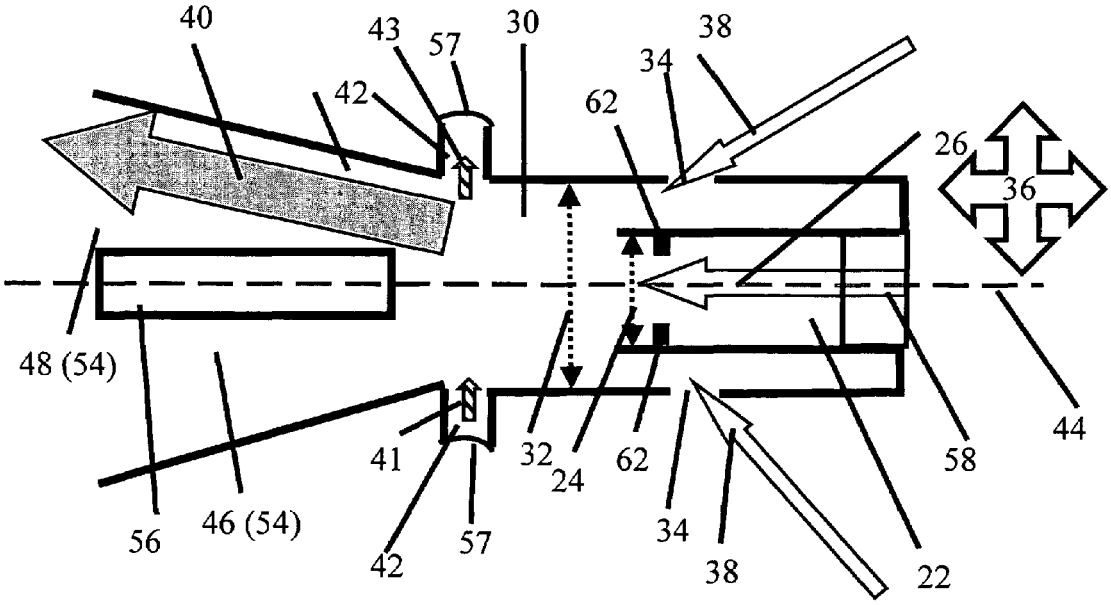

Optionally, but preferably, at least a portion of flow 26 emanating from jet port 22 is supplied by at least one oscillatory zero-mass-flux jet 58 (FIGS. 4*c* and 4*d*). U.S. Pat. 6,751,530 provides details of the principles of operation of oscillatory zero-mass-flux jets and is fully incorporated herein by reference in that regard.

Optionally, but preferably, flow 26 is mixed in proximity to a junction between jet port 22 and conduit 30. Mixing may be accomplished by means of a mixer 60. Mixer 60 may rely, at least in part, upon at least one protrusion 62 from an inner surface of jet port 22. Protrusion(s) 62 create a disturbance in flow 26 as flow 26 passes thereupon and mixing results. One to ten protrusions 62 are preferably employed, more preferably two to eight, more preferably two to six, most preferably three or four.

Alternately, or additionally, mixer 60 may include an active oscillatable (mechanical or fluidic) device, capable of introducing sufficient unsteadiness to the flow such that mixing is enhanced.

Iterative repetition of direction and redirection of amplified flow 40 as detailed hereinabove may be accomplished by a wide variety of deflection devices 42 including, but not limited to, the following three examples.

Figure 3:
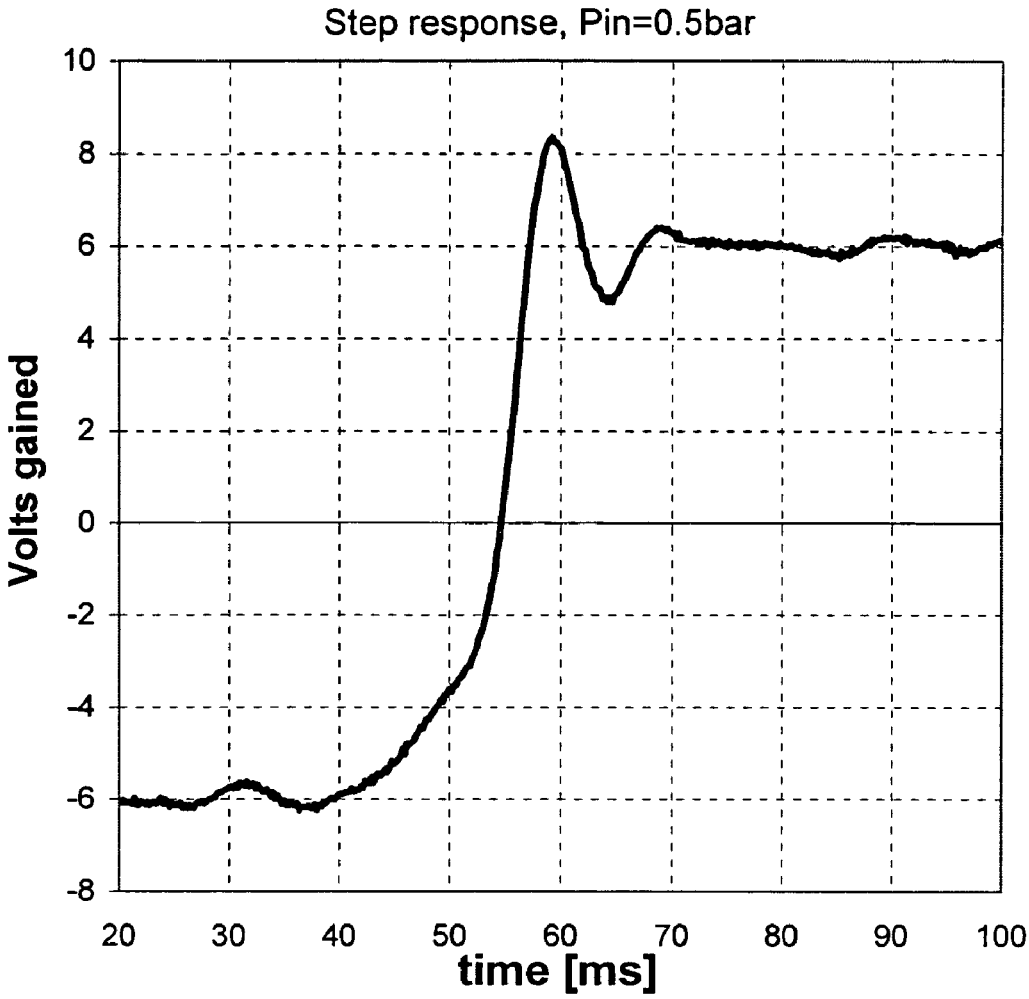
FIG. 3 is a plot of step response of the flow pressure (units of amplified voltage ) as a function of time for a mechanism according to the present invention, illustrating the quick transfer from one operational stare to another operational state.

Deflection device 42 may, for example, include at least one fluidic valve 64 (FIGS. 4*a* and 4*b*) capable of supplying at least a portion of (e.g. 41 and/or 43) pressure differential transverse to longitudinal axis 44 of flow 26 with a predetermined periodicity. Details of operation of fluidic valves 64 are set forth in more detail by Tesar et al (*New Ways of Fluid Flow Control in Automobiles: Experience with Exhaust Gas After treatment Control:* World Automotive Congress F2000H192; Seoul 2000 FISITA; Jun. 12–15, 2000, Seoul, Korea). FIGS. 1 and 3 of this document, and textual explanations thereof, are incorporated herein by reference. According to this embodiment (FIGS. 4*a* and 4*b*)

of the invention transverse pressure differential 41 and 43 is initially employed to direct amplified flow 40 in first exit direction 46 (FIG. 4*a*). In response to a command 76 from controller 70, the circumferential angle of transverse pressure differential 41 and 43 is rotated by 180 degrees and amplified flow 40 is directed to additional exit direction 48 (FIG. 4*b*). This process is iteratively repeated in response to commands 76 from controller 70 (FIG. 6). The end result is that amplified flow 40 oscillates between exit directions 46 and 48 at a frequency determined by controller 70.

Figure 4E:
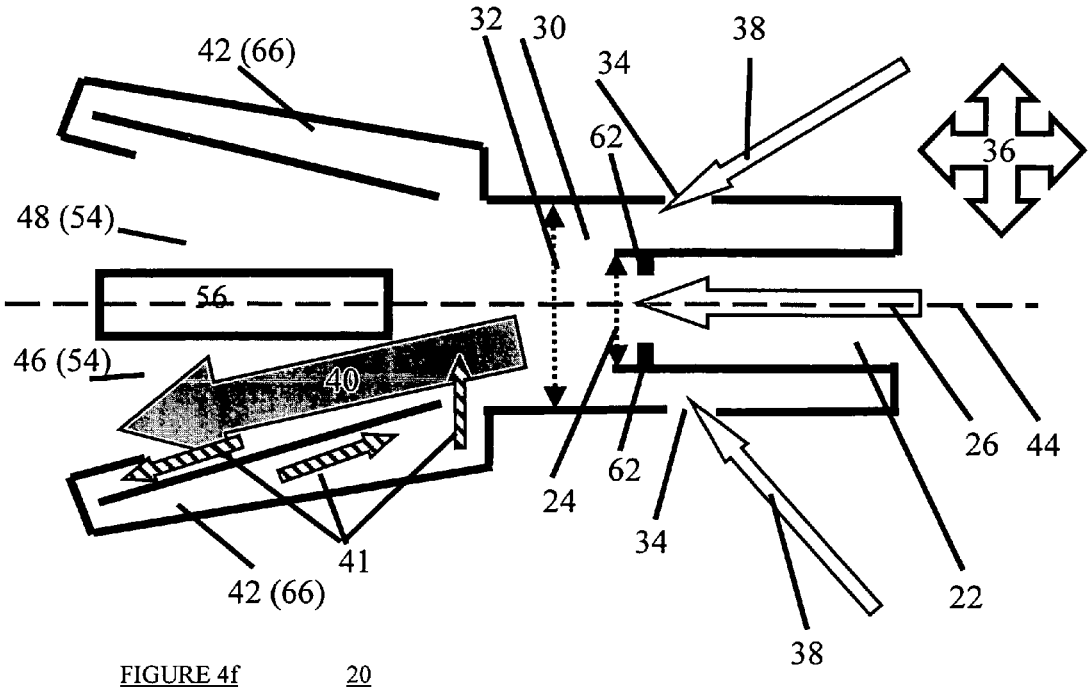
Figure 4F:
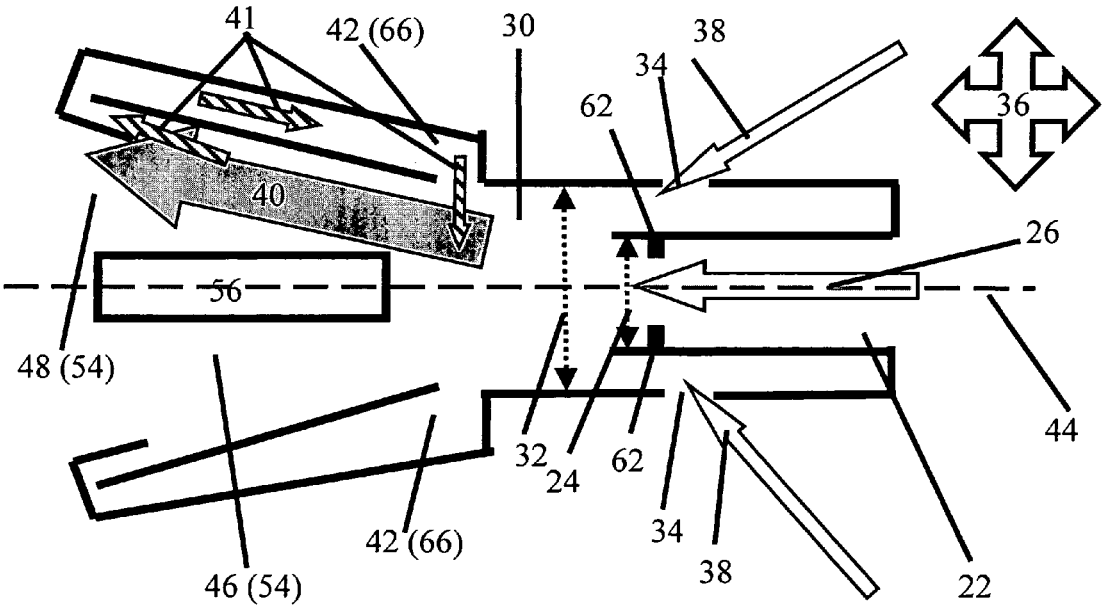
Figure 5:
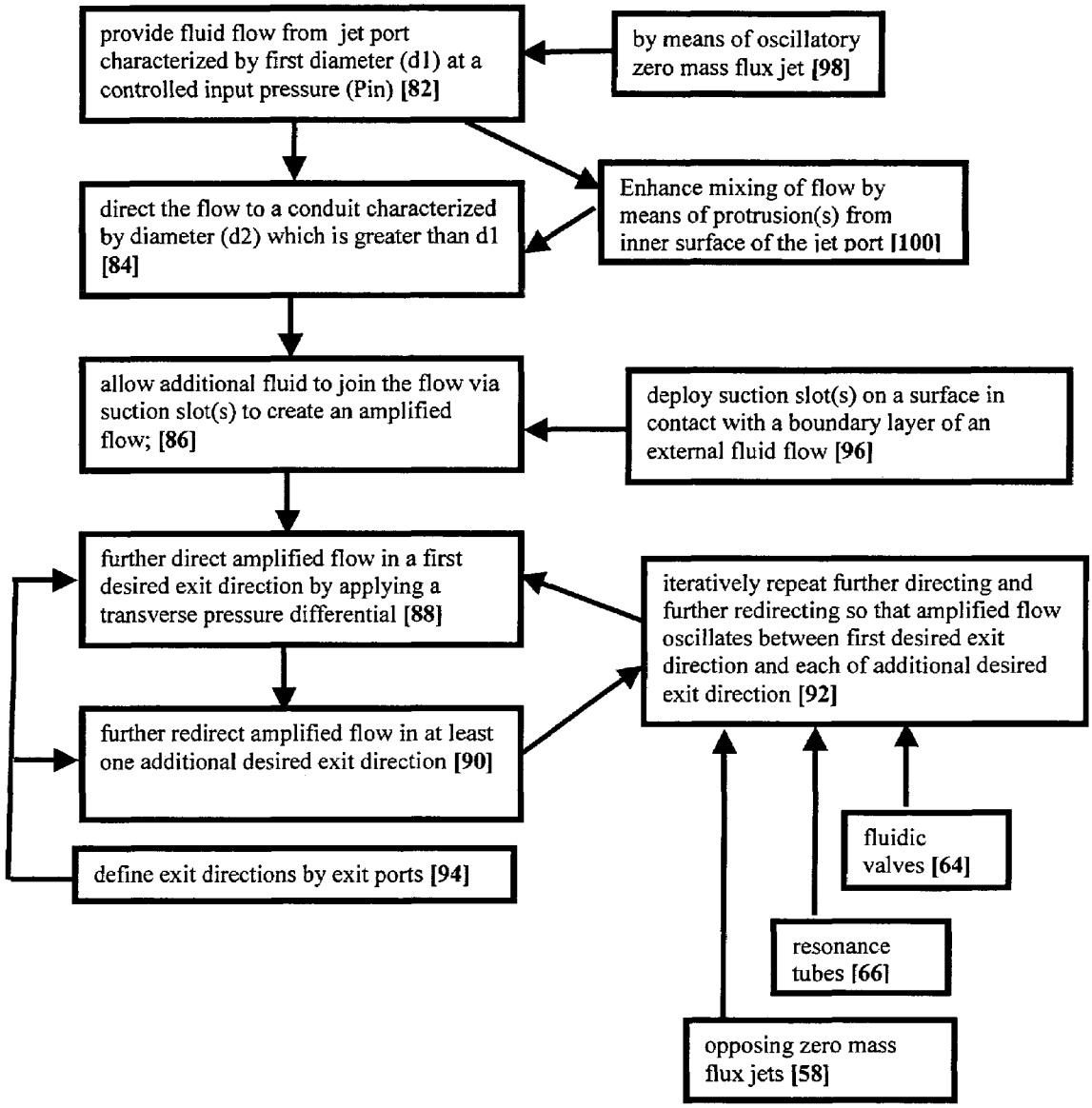
FIG. 5 is a simplified flow diagram illustrating a sequence of events associated with performance of a method according to the present invention.

Alternately, or additionally, deflection device 42 may, for example, include at least two resonance tubes 66 (FIGS. 4*e* and 4*f*). Each of resonance tubes 66 is independently capable of capturing a portion 41 of amplified flow 40 as it flows in one of desired exit directions 46 or 48 and applying captured portion 41 of amplified flow transverse 41 to longitudinal axis 44 of flow 26 to create pressure differential 41. This will cause amplified flow 40 to alter its exit direction. The process of switching between the operational states depicted in FIGS. 4*e* and 4*f* occurs with a predetermined periodicity. This periodicity is approximated by Equation 3:

$$f \approx \frac{aV_{sound}}{2L(1+a)} \qquad \text{Equation 3}$$

Where a is the ratio between the typical velocity in exit direction (port) 46(54) or 48(54), $V_{sound}$ is the speed of sound there and L is the length of resonance tube 66.

The predetermined periodicity may be modified by commands 76 from controller 70 to open, close or otherwise regulate (e.g., the length or diameter) of one or both of resonance tubes 66. According to additional preferred embodiments of the invention, more than two resonance tubes 66 are employed to define more than two exit directions 46 and 48.

Alternately, or additionally, deflection device 42 may include at least two opposing zero-mass-flux devices (FIGS. 4*c* and 4*d*) operating at a predetermined periodicity. Each of the zero mass flux devices 58 is capable of supplying at least a portion (41 and/or 43) of the pressure differential transverse to longitudinal axis 44 of the flow 26. Oscillation between exit directions 46 and 48 is achieved by causing zero mass flux devices 58 to operate out of phase so that at a first time point (FIG. 4*c*) one diaphragm 57 flexes into zero-mass-flux device 58 to create a positive pressure differential 41 while the diaphragm 57 of the second flexes out of zero-mass-flux device 58 to create a negative pressure differential 43. Amplified flow 40 is thus directed towards first exit direction 46 defined by exit port 54. At a subsequent time point, one half period of the oscillation frequency of zero mass flux devices 58, the situation is reversed (FIG. 4*d*) and amplified flow 40 is directed towards second exit direction 48 defmed by exit port 54. According to additional preferred embodiments of the invention, more than two zero mass flux devices 58 are employed to define more than two exit directions 46 and 48. Regardless of the total number of zero mass flux devices 58 employed, the total transverse pressure differential will be the vector sum of all partial pressure differentials 41 and 43.

According to alternate preferred embodiments of the invention, iteratively repeating is accomplished employing one oscillating membrane and connecting the control jets to opposing sides of the membrane.

The present invention is further embodied by a method 80 of producing a suction and periodic excitation flow. Method 80 includes providing 82 flow 26 from jet port 22 characterized by first diameter (d1; 24) at a controlled input pressure (Pin). Method 80 further includes directing 84 flow 26 to conduit 30 characterized by second diameter (d2; 32) wherein d2 is greater than d1. Method 80 further includes allowing 86 additional fluid 38 to join flow 26 through at least one suction slot 34 (as explained hereinabove) to create amplified flow 40. Method 80 further includes directing 88 amplified flow 40 in first desired exit direction 46 by applying transverse pressure differential (41 and/or 43) to longitudinal axis 40 of flow 26. Method 80 further includes redirecting 90 amplified flow 40 in at least one additional desired exit direction 48 by modifying a circumferential angle by which transverse pressure differential(41 and/or 43) is applied to longitudinal axis 44. Method 80 further includes iteratively repeating 92 further directing 88 and further redirecting 90 so that amplified flow 40 oscillates between first desired exit direction 46 and each of the at least one additional desired exit direction 48. Iterative repetition 92 may be accomplished using, for example, fluidic valves 56, resonance tubes 66 or oscillatory zero mass flux jets 58 as detailed hereinabove.

According to method 80, exit directions 46 and 48 are preferably defined 94 by exit ports 54.

Preferably suction slots 34 are deployed 96 on a surface in contact with a boundary layer of an external fluid flow 33.

Preferably flow 26 from jet port 22 is provided 98 by oscillatory zero mass fluxjet 58.

Optionally, but preferably, enhancement of mixing 100 of flow is accomplished by means of protrusion(s) from inner surface of the jet.

The present invention employs, for the first time, steady suction from a suction slot(s)/hole(s) optimally placed to counteract boundary layer separation in conjunction with an additional slot which permits exhaust of the air which entered the flow at the first slot from the boundary layer (and was optionally augmented), in a pulsatile fashion. This prevents downstream boundary layer separation in a manner which was not achievable using previously known alternatives. Reduction of these principles to practice has required exhaustive aerodynamic design and repeated experimental/numerical investigation in order to determine the optimal relative placement of the two (or more) slots as well as the frequency and magnitude of the control input(s). The scope of the invention further includes introduction of pulsatile excitation introduced at the uncontrolled separation location with suction applied downstream.

The present invention is expected to find utility in delay of external boundary layer separation in aerodynamic and hydrodynamic applications. Specific embodiments are lifting surfaces with high deflection angles (typically known as "high-lift systems"), aft bodies of helicopters and transport planes and aft regions in ground transportation systems (e.g., trucks, trains). Further, it is anticipated that additional applications will become apparent as a result of publication of this patent. All such additional applications of the claimed mechanism in its various embodiments are within the scope of the claimed invention a priori.

Additional objects, advantages, and novel features of the present invention will become apparent to one ordinarily skilled in the art upon examination of the following examples, which are not intended to be limiting. Additionally, each of the various embodiments and aspects of the present invention as delineated hereinabove and as claimed in the claims section below finds experimental support in the following examples.

EXAMPLES

Reference is now made to the following examples, which together with the above descriptions, illustrate the underlying principles of invention in a non-limiting fashion.

Generally, the nomenclature used herein and the laboratory procedures utilized in the present invention include flow control and fluid mechanics techniques which are generally described in references 1 through 15 listed hereinbelow, each of which is incorporated by reference as if fully set forth herein. Specific reference to these earlier publications are provided throughout this document. The procedures therein are believed to be well known in the art and are provided for the convenience of the reader. All the information contained therein is incorporated herein by reference.

Before presenting examples, reference is made to the following materials and methods employed in performance of experiments described in the examples.

Example 1

Alternation of Velocity Profiles by Suction Slots

In order to demonstrate that the theoretical advantages of suction in a mechanism according to the present invention may be realized in practice, a prototype with a d1 of 3 mm and a d2 of 10 mm was constructed. The suction slots were co-linear with the exit of the jet port and angled at 45 degrees with respect to the flow exiting the jet port.

Figure 2:
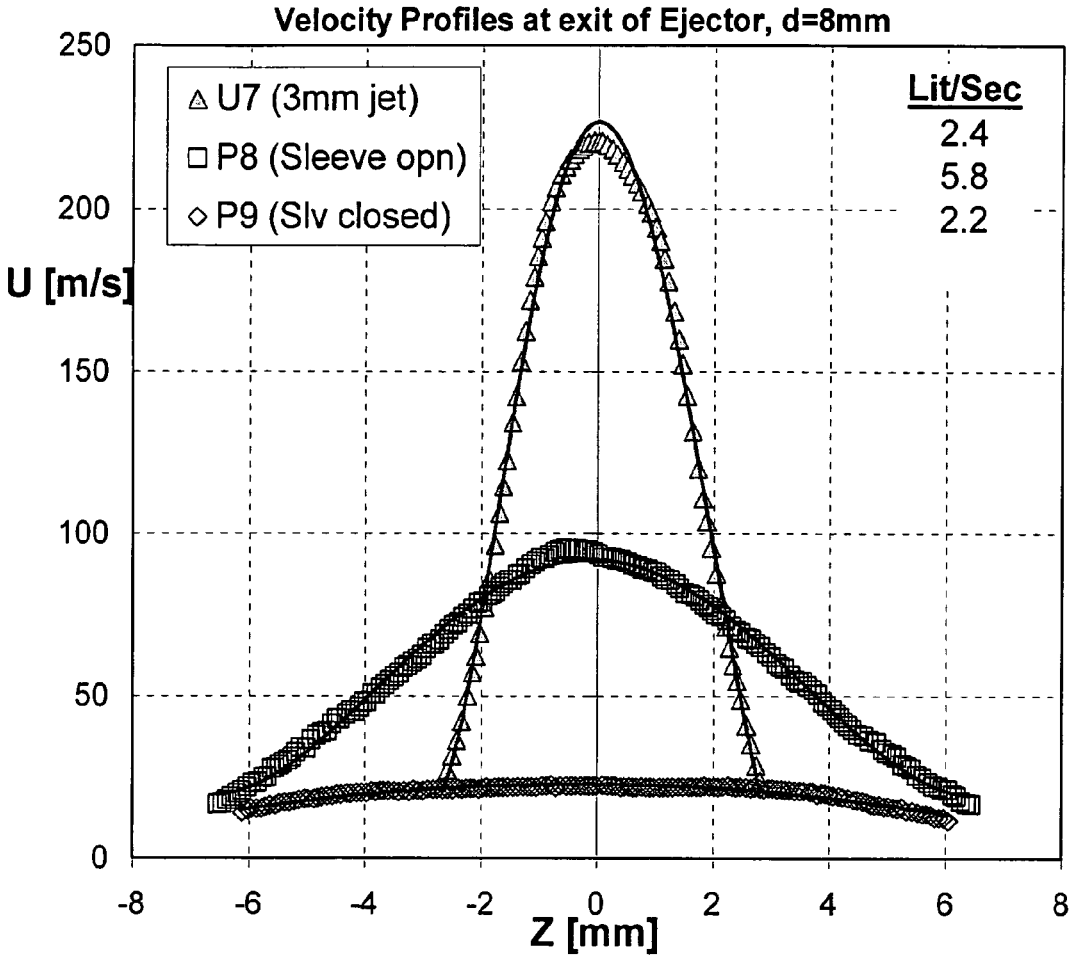
FIG. 2 is a comparative plot of velocity profiles at the exit from the jet port without a conduit (highest peak; marked with triangles); with a conduit according to the present invention in place but with suction ports according to the present invention closed (lowest plot; marked by diamonds); and with a conduit according to the present invention in place and suction ports according to the present invention open according to the present invention (intermediate peak; marked by squares).

FIG. 2 shows velocity profiles that were taken at the exit from the d2 jet port without the conduit (highest peak; marked with triangles); with the conduit in place but with the suction slots closed (lowest plot; marked by diamonds); and with the conduit in place and the suction slots open (intermediate peak; marked by squares). This demonstrates that the device is capable of significant amplification of the mass flow rate, as compared to the jet port operating in free air and/or as compared to the jet issuing into the conduit, but with suction ports closed.

Calculation of flow rate assuming a cylindrically symmetric flow indicates that opening of suction slots more than doubles the mass flow rate (5.8 L/s) relative to the same jet port without a conduit (2.4 L/s), assuming atmospheric static conditions at the location of measurement. This proves that the theoretical advantages of the claimed suction slots are realized in practice.

Example 2

De,pmstration of Device Step Response

The prototype described in example 1 was then equipped with a bilateral exit hood attached to the distal end of the conduit. The exit hood has a rectangular cross section of 8 mm by 10 mm. A deflection device with two 8 mm diameter ducts positioned at the junction between the conduit and the exit hood was employed to generate the required transverse pressure differential. The exit hood is 50 mm long and disperses the exit flow over an inclusive angle of 30 degrees. A deflection wedge with an angle of 15 degrees [8 mm height along all of its length] is insertable in the center of the hood. This serves to divide the hood into two defmed exit ports and to make possible oscillation of exit flow between the ports.

Initially the deflection wedge was placed 15 mm from the entrance to the hood although the design permits movement of the deflection wedge in 2 directions and makes possible examination of deflection wedge placement on the magnitude of the flow control required to shift the exit flow between the two exit ports.

Subsequently, the reaction of the frequency of the mechanism as a result of implementation of an inverse step on the two 8 mm diameter ducts of the deflection device was measured.

Unsteady pressure sensors were positioned below a Preston tube like device at the exit of the two ports 54 leading the flow out of the device. FIG. 3 demonstrates the difference between the two pressure meters and a clear step reaction can be noted. Such a reaction is typical of a second order system with a resonance frequency in the order of 100 Hz. The transition between two steady states, which occurs within 5 to 20 milliseconds (the plot in FIG. 3 is for a flow rate of 70 m/s at the exit port) indicates a reaction frequency response for the whole mechanism of 50 to 200 Hz.

These results indicate that the prototype device is capable of generating oscillatory flow at the alternate exit ports at large enough frequencies to be relevant to unsteady flow control applications. Furthermore, with smaller devices size AND for higher flow rates the frequency response is increased, a highly desirable feature in the context of unsteady flow control.

Taken in combination with results presented in example 1 hereinabove, these results establish that the mechanism which combines suction and oscillation can, for the first time, be implemented as described hereinabove to effectively control flow. Greatest benefits are in increased efficiency of control of boundary layer separation. The efficiency stems from the combination of several locations of control authority applications and from the inherent low resistance nature of the design of the device.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

REFERENCES

1. Seifert, A., Darabi, A. and Wygnanski, I., 1996, "Delay of Airfoil Stall by Periodic Excitation", *J of Aircraft.* Vol. 33, No. 4, pp. 691–699.
2. Seifert, A. and Pack, L. G., "Oscillatory Control of Separation at High Reynolds Numbers", *AIAA J.* Vol. 37, No. 9, Sep. 1999, pp. 1062–1071.

3. Seifert, A. and Pack, L. G., "Oscillatory Control of Shock-induced Separation", (AIAA paper 99–0925), J. Aircraft, May–June 2001, V38, N3, pp. 464–472.
4. Seifert, A. and Pack, L. G., "Effects of Compressibility and Excitation Slot Location on Active Separation Control at High Reynolds Numbers", J. Aircraft 40, (1): pp. 110–119 January–February 2003.
5. Prandtl, L. and Teitjens, O. G., "Applied Hydro and Aeromachanics", Dover, New-york, 1934.
6. Yehoshua, T. and Seifert, A. "Boundary Condition Effects on Oscillatory Momentum Generator", AIAA Paper 2003–3710, June 2003 (MSc thesis 2004, J. paper to be submitted during 2004).
7. Seifert, A., Eliahu, S., Greenblatt, D. and Wygnanski, I., 1998, "Use of Piezoelectric Actuators for Airfoil Separation Control (TN)", AIAA J., Vol. 36, No. 8, pp. 1535–1537.
8. Crittenden, T. M., Glezer, A., Funk, R. and Parekh, D., "Combustion-driven jet actuators for flow control", AIAA Paper 2001–2768, June 2001.
9. Maryland Spark jet actuator
10. Michael J. Brear, Zachary Warfield, John F. Mangus, Cpt. Steve Braddom, James D. Paduano and Jeffry S. Philhower, "Flow Separation Within The Engine Inlet Of An Uninhabited Combat Air Vehicle (UCAV)", FEDSM paper 2003–45579, 2003.
11. Lachman G V. (ed) Boundary layer and flow control. Vol. 1 and 2, Pergamon Press. 1961
12. Seifert, A. and Pack, L. G., "Active Control of Separated Flow on a Wall-mounted "Hump"at High Reynolds Numbers", AIAA J., V. 40, No. 7, July, 2002, pp. 1363–1372. (Part of AIAA paper 99–3430).
13. Seifert, A., Bachar, T., Koss, D., Shepshelovits, M. and Wygnanski, I., 1993, "Oscillatory Blowing, a Tool to Delay Boundary Layer Separation", AIAA J. Vol. 31, No. 11, pp. 2052–2060.
14. Rapoport, D., Fono, I., Cohen, K. and Seifert, A., "Closed-loop Vectoring Control of a Turbulent Jet Using Periodic Excitation", (AIAA paper 2002–3073), J. Propulsion and Power, V19, N4, July–August 2003, pp. 646–654.
15. S. Margalit, D. Greenblatt, A. Seifert and I. Wygnanski, "Active Flow Control of a Delta Wing at High Incidence Using Segmented Piezoelectric Actuators", AIAA paper 2002–3270, June 2002. In press to AIAA J. Aircraft, 2003.

What is claimed:

1. A method of producing a suction and periodic excitation flow, the method comprising:

(a) providing a flow of a fluid from a jet port characterized by a first diameter (d1) at a controlled input pressure (Pin);

(b) directing said flow to a conduit characterized by a second diameter (d2) wherein d2 is greater than d1;

(c) allowing additional fluid to join said flow through at least one suction slot to create an amplified flow; said at least one suction slot in fluid communication with said conduit;

(d) further directing said amplified flow in a first desired exit direction by applying a transverse pressure differential to a longitudinal axis of said flow;

(e) further redirecting said amplified flow in at least one additional desired exit direction by modifying a circumferential angle by which said transverse pressure differential is applied to said longitudinal axis; and (f) iteratively repeating said further directing and further redirecting so that said amplified flow oscillates between said first desired exit direction and each of said at least one additional desired exit direction.

2. The method of claim 1, wherein each of said first desired exit direction and each of said at least one additional desired exit direction are independently defined by an exit port belonging to a plurality of exit ports.

3. The method of claim 1, wherein said at least one additional desired exit direction comprises a single additional exit direction.

4. The method of claim 2, wherein said at least one additional desired exit direction comprises at least two additional exit directions.

5. The method of claim 1, wherein a ration between said d2 and d1 is in the range of 1.1:1 and 5:1.

6. The method of claim 1, further comprising deploying said at least one suction slot on a surface in contact with a boundary layer of an external fluid flow so that said additional fluid entering said flow via said at least one suction slot includes at least a portion of said external fluid flow.

7. The method of claim 1, wherein said providing a flow of said fluid from said jet port is at least partially accomplished by means of at least one oscillatory zero-mass-flux jet.

8. The method of claim 1, further comprising enhancing of mixing said flow in proximity to a junction between said jet port and said conduit.

9. The method of claim 8, wherein said enhancing of said mixing is accomplished by means of at least one protrusion from an inner surface of said jet port, said at least one protrusion creating a disturbance in said flow as said flow passes thereupon.

10. The method of claim 1, wherein said iteratively repeating is accomplished by a mechanism selected from the group consisting of:

(i) at least one fluidic valve capable of supplying at least a portion of said pressure differential transverse to a longitudinal axis of said flow with a predetermined periodicity;

(ii) at least two resonance tubes, each independently capable of capturing a portion of said amplified flow as said amplified flow flows in one of said desired exit directions and applying said captured portion of said amplified flow transverse to said longitudinal axis of said flow to create said pressure differential with a predetermined periodicity; and (iii) operating at least two opposing zero-mass-flux devices at a predetermined periodicity, each of said zero mass flux devices capable of supplying at least a portion of said pressure differential transverse to a longitudinal axis of said amplified flow.

11. A suction and periodic excitation flow mechanism, the mechanism comprising:

(a) a jet port characterized by a first diameter (d1), said jet port capable if directing a flow of a fluid at a controlled input pressure (Pin);

(b) a conduit characterized by a second diameter (d2) wherein d2 is greater than d1, said conduit in fluid communication with said jet port and capable of receiving said flow from said jet port;

(c) at least one suction slot in fluid communication with said conduit and an environment external to the mechanism, said at least one suction slot capable of allowing additional fluid to join said flow to create an amplified flow;

(d) a deflection device capable of applying a transverse pressure differential to a longitudinal axis of said flow to direct said amplified flow in a first desired exit direction and further capable of redirecting said amplified flow in at least one additional desired exit direction by modifying a circumferential angle by which said pressure differential is transverse to said longitudinal axis; and (e) a controller, said controller capable of commanding said deflection device to perform at least one finction selected from the group consisting of:

(i) apply a transverse pressure differential to a longitudinal axis of said flow to direct said amplified flow in a first desired exit direction;

(ii) iteratively repeat a predetermined set of modifications of said circumferential angle by which said pressure differential is transverse to said longitudinal axis so that said amplified flow oscillates between said first desired exit direction and each of said at least one additional desired exit direction; and (iii) cease operation.

12. The mechanism of claim 11, wherein each of said first desired exit direction and each of said at least one additional desired exit direction are independently defined by an exit port belonging to a plurality of exit ports.

13. The mechanism of claim 11, wherein said at least one additional desired exit direction comprises a single additional exit direction.

14. The mechanism of claim 12, wherein said at least one additional desired exit direction comprises at least two additional exit directions.

15. The mechanism of claim 11, wherein a ration between said d2 and d1 is in the range of 1.1:1 and 5:1.

16. The mechanism of claim 11, wherein said at least one suction slot is deployed on a surface in contact with a boundary layer of an external fluid flow so that said additional fluid entering said flow via said at least one suction slot includes at least a portion of said external fluid flow.

17. The mechanism of claim 11, wherein said deflection device at least partially relies upon at least one oscillatory zero-mass-flux jet.

18. The mechanism of claim 11, further comprising a mixerO. capable of mixing said flow as it passes from said jet port to said conduit.

19. The mechanism of claim 18, wherein said mixer includes at least one protrusion from an inner surface of said jet port, said at least one protrusion creating a disturbance in said flow as said flow passes thereupon, said disturbance resulting in said mixing.

20. The mechanism of claim 11, wherein said deflection device employs at least one item selected from the group consisting of:

(i) at least one fluidic valve capable of supplying at least a portion of said transverse pressure differential to a longitudinal axis of said amplified flow with a predetermined periodicity;

(ii) at least two resonance tubes, each independently capable of capturing a portion of said amplified flow as said amplified flow flows in one of said desired exit directions and applying said captured portion of said amplified flow transverse to said longitudinal axis of said amplified flow to create said transverse pressure differential with a predetermined periodicity; and (iii) at least two opposing zero mass flux devices operating at a predetermined periodicity, each of said zero mass flux devices capable of supplying at least a portion of said transverse pressure differential to a longitudinal axis of said amplified flow.

* * * * *